US007654420B2

(12) United States Patent
Honda et al.

(10) Patent No.: US 7,654,420 B2
(45) Date of Patent: Feb. 2, 2010

(54) DISCHARGE CONTAINER

(75) Inventors: Taichi Honda, Nishinomiya (JP); Tsutomu Kobayashi, Ibaraki (JP); Hideo Uemura, Ibaraki (JP)

(73) Assignees: The Procter and Gamble Company, Cincinnati, OH (US); Yoshino Kogyosho Co., Ltd., Tokyo (JP)

( * ) Notice: Subject to any disclaimer, the term of this patent is extended or adjusted under 35 U.S.C. 154(b) by 714 days.

(21) Appl. No.: 10/589,885

(22) PCT Filed: Dec. 20, 2005

(86) PCT No.: PCT/JP2005/023360

§ 371 (c)(1),
(2), (4) Date: Aug. 18, 2006

(87) PCT Pub. No.: WO2006/075484

PCT Pub. Date: Jul. 20, 2006

(65) Prior Publication Data

US 2007/0205226 A1 Sep. 6, 2007

(30) Foreign Application Priority Data

Dec. 24, 2004 (JP) ..... 2004-373023

(51) Int. Cl.
*B67D 5/42* (2006.01)
*G01F 11/00* (2006.01)

(52) U.S. Cl. ..... 222/386; 222/405; 222/252

(58) Field of Classification Search ..... 222/142.1, 222/424.5, 425, 454, 456, 545, 548, 142.2, 222/142.6, 142.7, 144, 142.9, 145.1, 405, 222/252, 138, 386
See application file for complete search history.

(56) References Cited

U.S. PATENT DOCUMENTS

| | | | | |
|---|---|---|---|---|
| 2,188,249 | A * | 1/1940 | Pringsauf | 222/387 |
| 3,220,615 | A * | 11/1965 | Spatz | 222/252 |
| 3,563,414 | A | 2/1971 | Coulombe | |
| 3,760,985 | A * | 9/1973 | Bryan | 222/136 |
| 4,796,784 | A * | 1/1989 | Spirk et al. | 222/80 |
| 5,720,416 | A * | 2/1998 | Izoe | 222/138 |

FOREIGN PATENT DOCUMENTS

| | | |
|---|---|---|
| JP | U 49-26384 | 3/1974 |
| JP | U 59-10714 | 1/1984 |
| JP | B2 62-8839 | 2/1987 |
| JP | U 4-7476 | 1/1992 |

* cited by examiner

*Primary Examiner*—Kevin P Shaver
*Assistant Examiner*—Stephanie E Tyler
(74) *Attorney, Agent, or Firm*—Oliff & Berridge, PLC

(57) ABSTRACT

A discharge container that discharges an appropriated amount of a creamy cosmetic, medical supply, or the like. The discharge container may include a cylindrical body and a cylindrical lid with a top. The lid covers an opening, and is rotatably engaged with the opening. A top wall portion of the top is brought into sliding contact with an upper end surface of a rotatable partitioning plate such that any contents in the discharge container are pressed by relative rotation between the container body and the lid, resulting in the contents being discharged through a discharge opening provided on the top wall.

4 Claims, 8 Drawing Sheets

(a)

(b)

DISCHARGE CONTAINER

TECHNICAL FIELD

The present invention relates to a container capable of discharging an appropriate amount of creamy cosmetics, medical supplies and the like.

BACKGROUND ART

Currently, a container in the form of a jar having a wide opening and a lid has been used to store contents such as cream, ointment and gel used as cosmetics and medical supplies. For taking out the contents from the container of this type, a user scoops the contents with a finger. However, it sometimes occurs that too much amount of the contents is taken out and the surplus contents are returned to the container, which is unhygienic. Also, since the area of the contents in direct contact with the air is large, there is a possibility of quality deterioration of the contents due to oxidation or for other reason.

For overcoming the above problems, a discharge container capable of discharging an appropriate amount of contents within a container body by rotation of its lid has been proposed in Patent Reference 1. According to this container, a pair of partitioning plates are radially disposed within the container body. Upon use, the center angle between both the partitioning plates is decreased by the relative rotation of between the lid and the container body so as to press the contents existing between the partitioning plates. Then, an appropriate amount of the contents is discharged through a discharge opening provided at the center of the lid.

Patent Reference 1: JP-B-62-8839

DISCLOSURE OF THE INVENTION

Problems that the Invention is to Solve

According to the container disclosed in Patent Reference 1, however, pressure needs to be effectively applied to the contents existing between the pair of the partitioning plates. When the sealing of the space between the partitioning plates is insufficient, for example, a desired amount of contents may not be discharged. On the other hand, when the sealing of the space is tightened, the rotation is not smoothly effected. Other problems have been arising from the container disclosed in the above reference.

Wherefore, the invention has been developed to solve the above problems arising from a discharge container having such a rotation mechanism. In particular, it is an object of the invention to provide a discharge container for discharging creamy contents, in which sealing between partitioning plates and a container body is more tightened but smooth sliding therebetween is not deteriorated such that usability of the container can be enhanced.

Means for Solving the Problems

For solving the above problems, an aspect of the invention according to Claim 1 is a discharge container, including:

a cylindrical container body with a bottom which includes a cylindrical wide opening disposed at the top end of the container body, a support extending upward from a bottom wall along a center axis, and a fixed partitioning plate extending from a region from a peripheral wall to a bottom wall as a base end to partition the inside of the container body in a radial direction;

a rotor which includes a cylindrical shaft piece rotatably engaging with the outer surface of the support, and a rotatable partitioning plate extending from the cylindrical shaft piece as a base end to be arranged in a radial direction along with the fixed partitioning plate; and a cylindrical lid with a top which has a top wall having a saucer-shaped upper surface, and a downwardly extending shaft extending downwardly from the lower surface of the top wall and engaging with the inner surface of the cylindrical shaft piece from above such that the downwardly extending shaft cannot rotate therein, the lid covering the cylindrical opening as a lid and rotatably engaging with the cylindrical opening, wherein:

the edge of the fixed partitioning plate is brought into sliding contact with the cylindrical shaft piece;

the edge of the rotatable partitioning plate is formed by a spatula-shaped sliding member made of soft material which is brought into sliding and linear contact with an area from the peripheral wall to the bottom wall of the container body;

the lower surface of the top wall is brought into sliding contact with the upper end surfaces of the cylindrical opening and the fixed partitioning plate and brought into contact with the upper end surface of the rotatable partitioning plate;

an storage chamber is formed by the fixed partitioning plate, the rotatable partitioning plate, the peripheral wall, the bottom wall, the cylindrical shaft piece, and the top wall;

a discharge opening communicating with the storage chamber is provided on the top wall; and the capacity of the storage chamber is reduced by decreasing a central angle between the fixed partitioning plate and the rotatable partitioning plate by the relative rotation between the container body and the lid, whereby contents within the container are pressed and discharged from the discharge opening to the upper surface of the top wall.

The container according to Claim 1 is chiefly constituted by the three components of the container body, the rotor and the lid. The rotor and the lid are attached to each other such that they cannot rotate, and those components are rotatably attached and fixed to the container body. The storage chamber to store the contents is formed by the fixed partitioning plate provided within the container body to partition the inside of the container body in the radial direction, the peripheral wall and bottom wall of the container body, the cylindrical shaft piece and the rotatable partitioning plate of the rotor, which plate is arranged in the radial direction along with the fixed partitioning plate, and the top wall of the lid.

The edge of the fixed partitioning plate is brought into sliding contact with the cylindrical shaft piece. The edge of the rotatable partitioning plate is formed by a spatula-shaped sliding member made of soft material which is brought into sliding and linear contact with an area from the peripheral wall to the bottom wall of the container body. The lower surface of the top wall is brought into sliding contact with the upper end surfaces of the cylindrical opening and the fixed partitioning plate, and brought into contact with the upper end surface of the rotatable partitioning plate. Thus, the storage chamber containing the creamy contents can be substantially closed except the area of the discharge opening provided on the top wall.

By the relative rotation between the container body and the lid after such a state, the capacity of the storage chamber is reduced by decreasing the central angle between the fixed partitioning plate and the rotatable partitioning plate in the radial direction, whereby contents within the container are pressed and discharged from the discharge opening to the upper surface of the top wall.

In particular, the edge of the rotatable partitioning plate is formed by the spatula-shaped sliding member made of soft material, and is brought into sliding and linear contact with the area from the peripheral wall to the bottom wall of the container body while being elastically deformed. Since the edge of the sliding member can be elastically deformed with ease while the sliding member is sliding, the sliding member can slide along the shape of the inner surface of the container body with slight resistance while securely retaining the tightness of sealing. Accordingly, an appropriate amount of discharge can be securely obtained by smooth rotational operation. Also, the contents can be completely scraped from the inner surface of the container body without leaving the contents inside the container, and thus the contents can be used up without any loss.

An almost fixed amount of contents is discharged to the upper surface of the top wall by fixed rotational operation, and the discharged contents are scooped with a finger. Since it is not needed to dip the finger into the inside of the container body, the finger is not contaminated more than necessary and the contents can be consumed hygienically and conveniently without any loss.

Since the capacity reduction of the storage chamber decreases the pressure in the space on the side opposite to the storage chamber side partitioned by the two partitioning plates, an air intake hole communicating with the space on the opposite side is provided on the top wall.

Another aspect of the invention according to Claim 2 is a discharge container, wherein the lower surface of the top wall is brought into sliding contact with the upper end surfaces of the cylindrical opening and the fixed partitioning plate and brought into contact with the upper end surface of the rotatable partitioning plate via a packing.

In the structure according to Claim 2, the tightness of sealing in the upper region of the storage chamber is more securely provided. Thus, the contents can be more effectively discharged without leakage of the contents to the outside.

A further aspect of the invention according to Claim 3 is a discharge container according to Claim 1 or 2, wherein:

the lid includes a short cylindrical lid part with a bottom having a bottom plate, and a cylindrical cap with a top which has a saucer-shaped top plate having the discharge opening at its center;

the cap covers the lid part from above as a cover such that the cap tightly engages with the outer surface of the lid part and cannot rotate, and rotatably engages with the upper end of the container body;

the top wall has double walls of the bottom plate and the top plate;

the downwardly extending shaft extends downwardly from the center of the lower surface of the bottom plate;

an outlet hole communicating with the inside of the container body is provided on the peripheral region of the bottom plate; and a flow passage extending from the outlet hole to the discharge opening is formed between the bottom plate and the top plate.

The structure according to Claim 3 is characterized in that: the lid is formed by the two components of the lid part and the cap; the top wall has the double walls of the bottom plate and the top plate; and the flow passage extending from the outlet hole provided on the peripheral portion of the bottom plate to the discharge opening provided at the center of the top plate is formed between the double walls. During the relative rotation between the two partitioning plates, the linear speed of the movement of the partitioning plates is higher at the peripheral position. Thus, the pressure is rapidly raised, and the contents can be discharged through the outlet hole, flow passage and discharge opening substantially in synchronization with the rotational operation.

ADVANTAGE OF THE INVENTION

The invention having the above structure offers the following advantages. In the aspect of the invention according to Claim 1, in particular, the edge of the rotatable partitioning plate is formed by the spatula-shaped sliding member made of soft material. Thus, the sliding member can slide along the shape of the inner surface of the container body with slight resistance while more securely retaining the tightness of sealing. Accordingly, an appropriate amount of discharge can be easily and securely obtained by smooth rotational operation. Also, the contents can be completely scraped from the inner surface of the container body without leaving the contents inside the container, and thus the contents can be used up without any loss.

In the aspect of the invention according to Claim 2, the tightness of sealing in the upper region of the storage chamber can be more securely provided. Thus, the contents can be more effectively discharged without leakage of the contents to the outside.

In the aspect of the invention according to Claim 3, since the linear speed of the movement of the partitioning plates increases at the peripheral position, the pressure instantly rises and it is thus possible to discharge the contents through the outlet hole, the flow passage and the discharge opening substantially in synchronization with the rotational operation without time lag.

DESCRIPTION OF REFERENCE NUMERALS AND SIGNS

Figure 1:
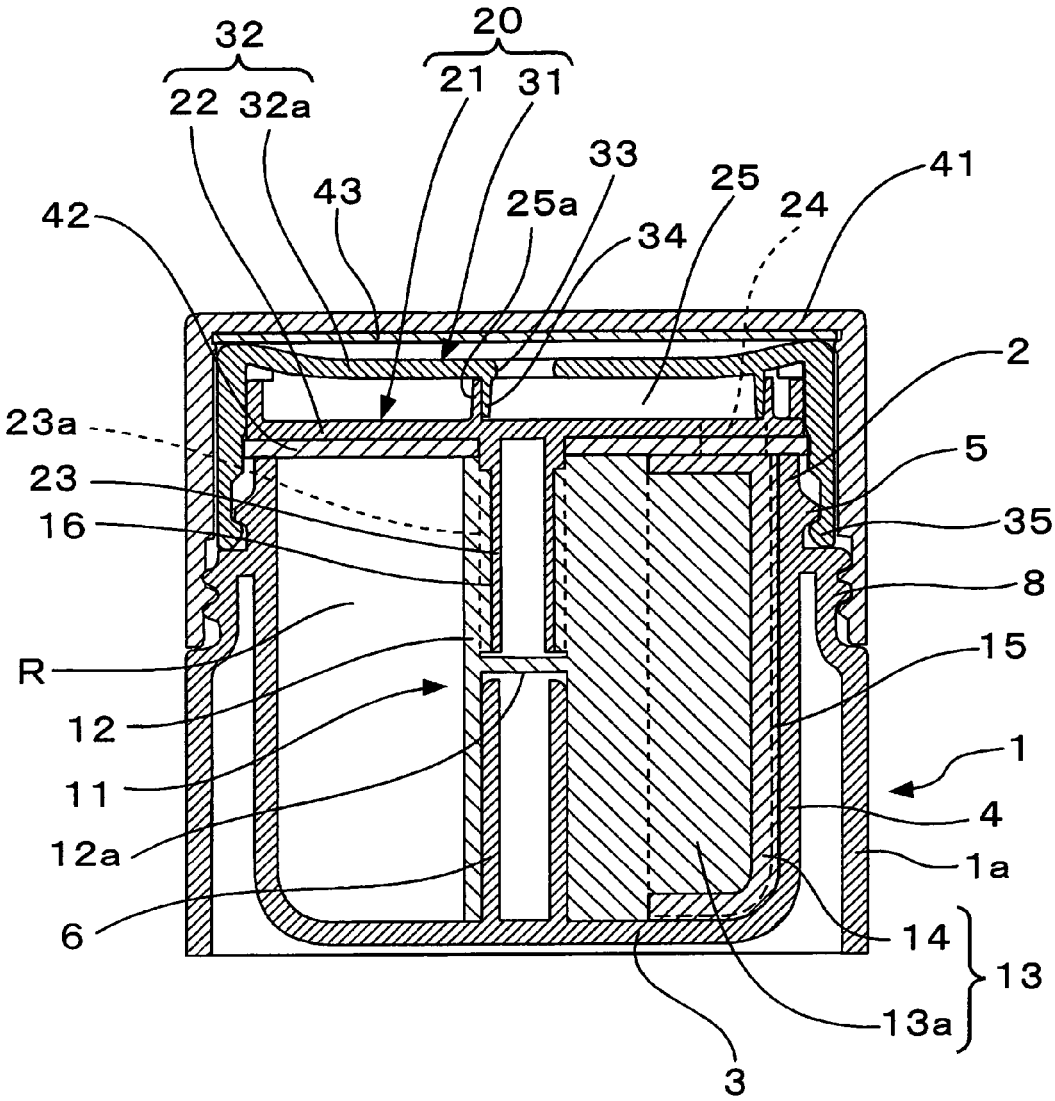
FIG. 1 is a vertical cross-sectional view of a container in a first embodiment according to the invention.

1; container body
1*a*; cylindrical skirt
1*b*; outside bottom
2; cylindrical opening
3; bottom wall
4; peripheral wall
5; circumferential linear engaging convex

6; support
7; fixed partitioning plate
8; screwed portion
11; rotor
12; cylindrical shaft piece
12*a*; intermediate bottom
13; rotatable partitioning plate
13*a*; plate piece
14; sliding member
15; blade
16; vertically extending linear convex
20; lid
21; lid part
22; bottom plate
23; downwardly extending shaft
23*a*; vertical groove
24; outlet hole
25; flow passage
25*a*; cylindrical passage piece
26; air intake hole
27; short and cylindrical engaging piece
31; cap
31*a*; cap cover
32; top wall
32*a*; top plate
32*b*; concave
33; discharge opening
34; downwardly extending cylindrical passage piece
35; circumferential linear engaging convex
36; short and cylindrical engaging piece
41; over cap
41*a*; over cap cover
42; packing
43; packing
R; storage chamber

BEST MODE FOR CARRYING OUT THE INVENTION

Figure 2:
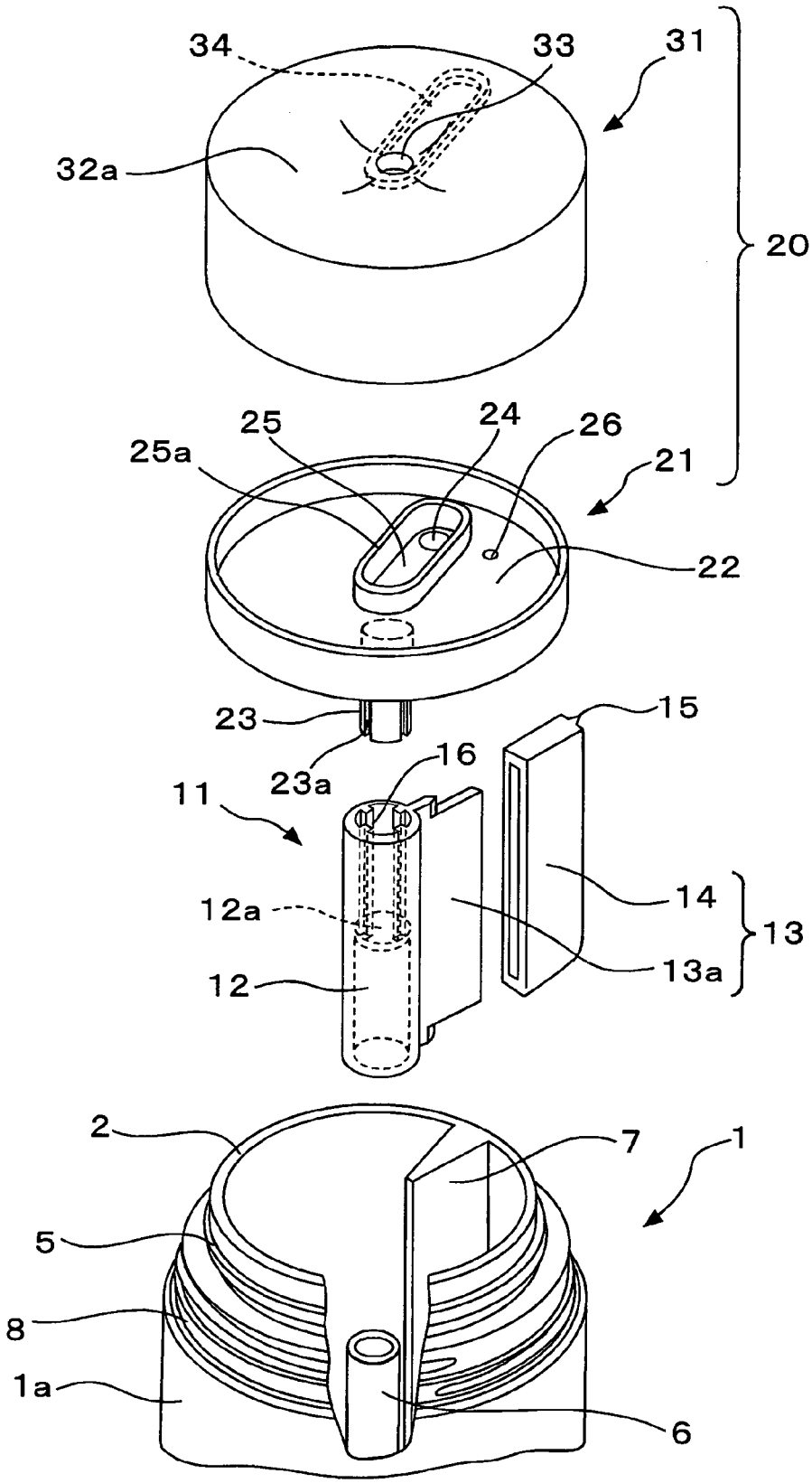
FIG. 2 is an explanatory perspective view illustrating disassembled main components of the container shown in FIG. 1.
Figure 3:
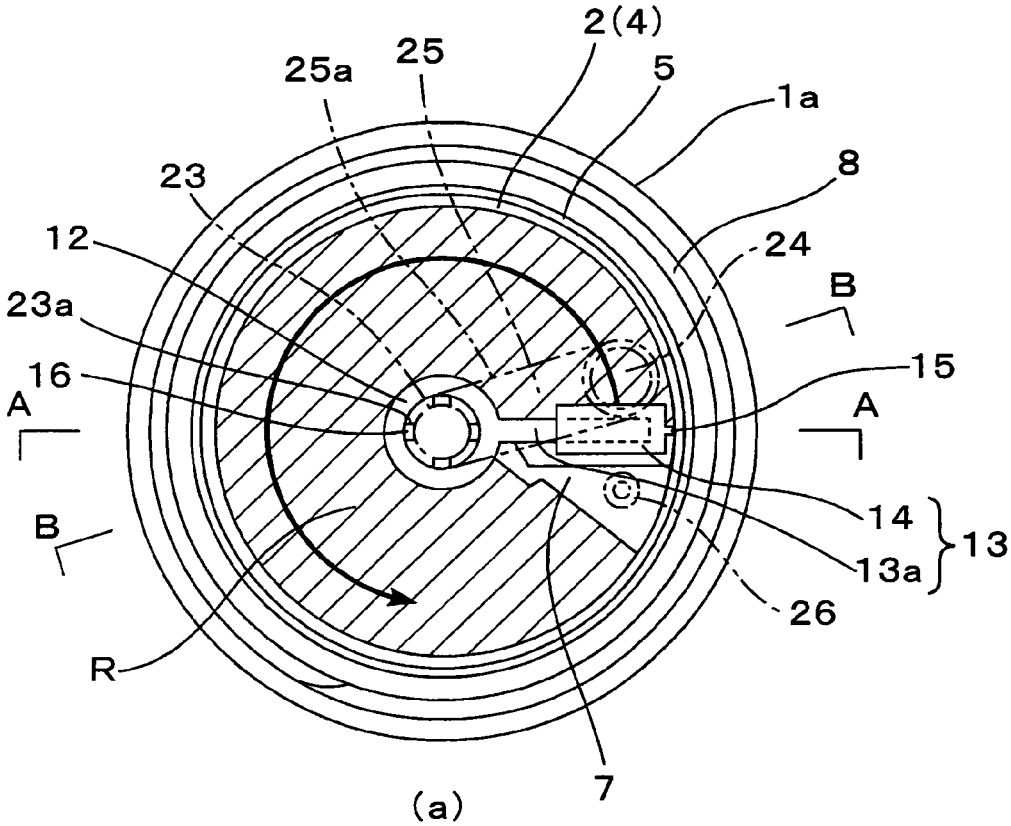
FIGS. 3(*a*) and 3(*b*) are plan views illustrating a condition where a container body and a rotor of the container shown in FIG. 1 are attached, wherein FIG. 3(*a*) shows a condition prior to use and FIG. 3(*b*) shows a condition where contents are used up.
Figure 3:
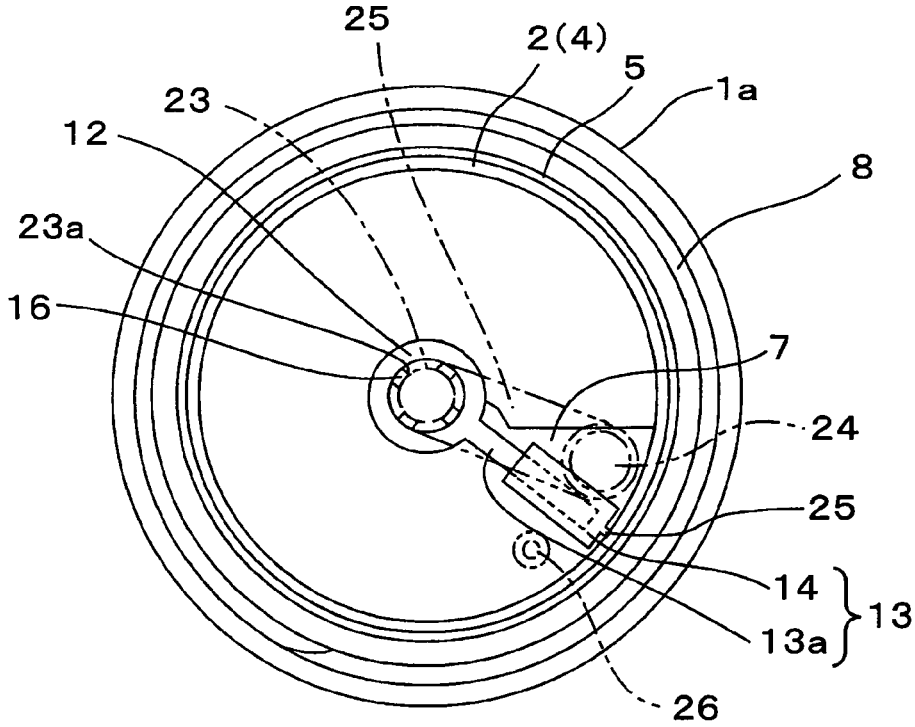
Figure 4:
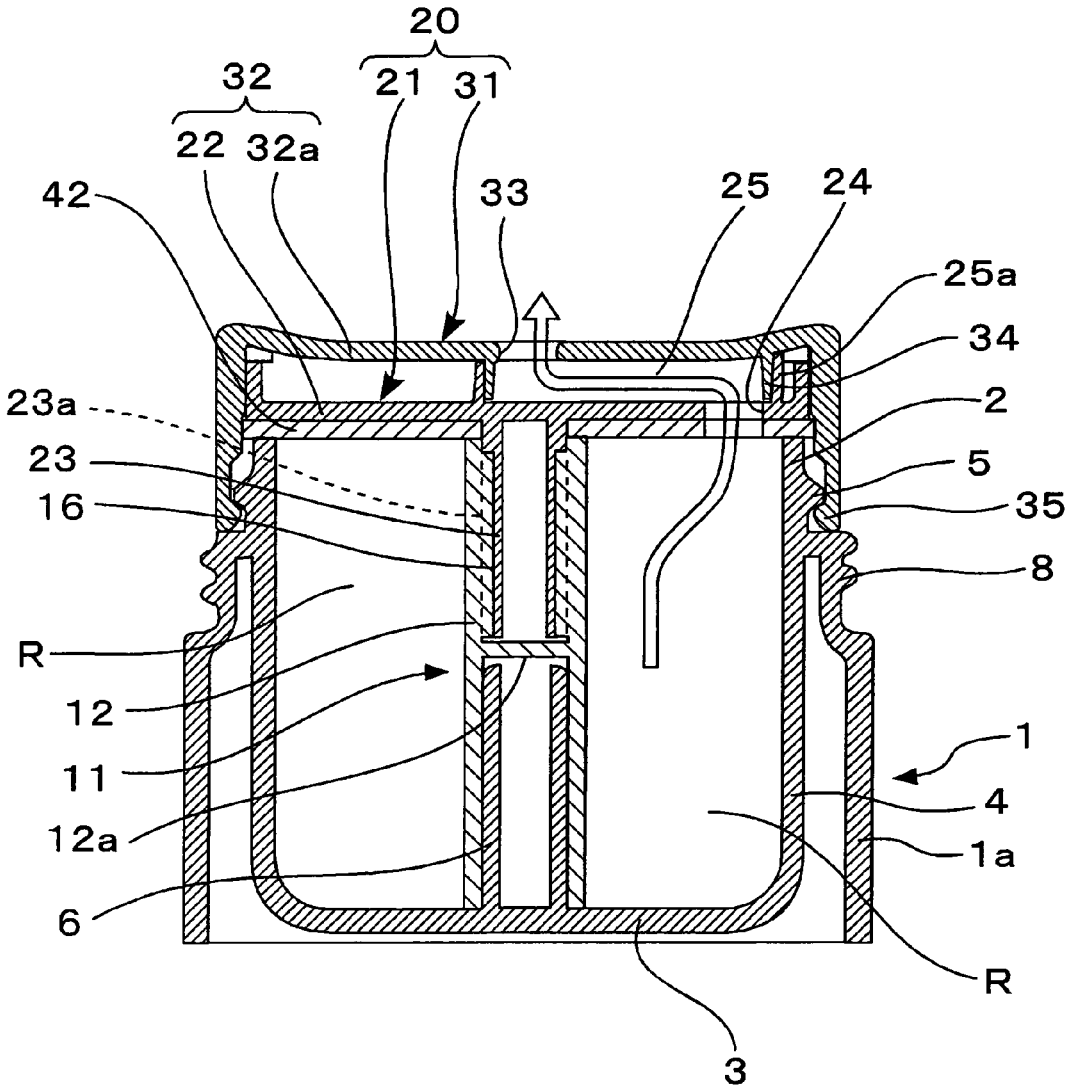
FIG. 4 is a vertical cross-sectional view taken along a line B-B in FIG. 3(*a*).

Embodiments according to the invention are now described with reference to the appended drawings. FIGS. 1 through 4 illustrate a discharge container in a first embodiment according to the invention. FIG. 1 is a vertical cross-sectional view of the container taken along a line A-A in FIG. 3 (*a*). FIG. 2 is a perspective view illustrating main components disassembled. FIGS. 3(*a*) and 3(*b*) are plan views illustrating a container body 1 and a rotor 11 attached thereto, wherein FIG. 3(*a*) shows a condition prior to use and FIG. 3(*b*) shows a condition after contents are used up. FIG. 4 is a vertical cross-sectional view of the container taken along a line B-B in FIG. 3(*a*) (an over cap 41 is removed). The main components included in the container, which are the container body 1, the rotor 11 and a lid 20, are made of synthetic resin. The lid 20 is constituted by two components of a lid part 21 and a cap 31, and the over cap 41 covers the lid 20 from above.

The container body 1 is a cylindrical component having a bottom and a cylindrical wide opening 2. The area from a peripheral wall 4 to a bottom wall 3 of the outside surface of the container body 1 is covered with a cylindrical skirt 1*a*. Since the container covered with the cylindrical skirt 1*a* is stabilized while placed on a table or the like, it is possible to effect rotational action with one hand while the container is on the table. A cylindrical support 6 extends upward from the bottom wall 3 along the center axis. A fixed partitioning plate 7, which extends from an area from the peripheral wall 4 to the bottom wall 3 as a base end, partitions the inside of the container in a radial direction.

The lower end of the rotor 11 has a cylindrical shaft piece 12 which rotatably engages with the outer surface of the support 6. The rotor 11 also has a rotatable partitioning plate 13 extending from the cylindrical shaft piece 12 as its base end throughout the height of the rotor 11. In this embodiment, the rotatable partitioning plate 13 is constituted by a plate piece 13*a* and a sliding member 14 which is made of spatula-shaped soft material to be attached and fixed to the edge of the plate piece 13*a* in such a manner that the sliding member 14 covers the plate piece 13*a*. A blade 15 having an acute-angled edge is provided from the side end to the bottom of the sliding member 14 such that the blade 15 can be brought into linearly sliding or tightly sliding contact with the area from the peripheral wall 4 to the bottom wall 3 of the container body 1.

An intermediate bottom 12*a* is provided in a central position of the height of the cylindrical shaft piece 12 vertically extending linear convexes 16 are formed on the upper half inner surface of the cylindrical shaft piece 12. The vertically extending linear convexes 16 allow a downwardly extending shaft 23 of the lid part 21 to be described later to engage with the upper half inner surface of the cylindrical shaft piece 12 such that the downwardly extending shaft 23 cannot rotate.

The lid 20 is constituted by the two components of the lid part 21 and the cap 31. The lid part 21 is a short cylindrical component having a bottom as a whole. The lid part 21 has the downwardly extending shaft 23 which extends from the bottom surface of a bottom plate 22 along the center axis and engages with the upper end inner surface of the cylindrical shaft piece 12 such that rotation of the downwardly extending shaft 23 is prevented by vertical grooves 23*a*. A single circular outlet hole 24 is provided on a peripheral portion of the bottom plate 22. A cylindrical passage piece 25*a* is a short and cylindrical component having a long and narrow elliptical shape, and extends from the position of the outlet hole 24 to the center of the bottom plate 22 such that the passage piece 25*a* surrounds the outlet hole 24. The cylindrical passage piece 25*a* constitutes a flow passage 25 through which the contents flow together with a cylindrical passage piece 34 of the cap 31 to be described later. An air intake hole 26 is provided in the vicinity of the outlet hole 24.

The cap 31 is a cylindrical component having a top. The cap 31 has a saucer-shaped top plate 32*a*. A discharge opening 33 is formed at the center of the top plate 32*a*. The cylindrical passage piece 34 downwardly extends from the lower surface of the top plate 32*a*. A circumferential linear engaging convex 35 is provided on the inside circumferential surface at the lower end of the cap 31.

The cylindrical passage piece 34 liquid-tightly engages with the cylindrical passage piece 25*a*. By this engagement, the cap 31 and the lid part 21 are fixed to each other such that they cannot rotate, thereby constituting the lid 20. The circumferential linear engaging convex 35 formed on the inside circumferential surface at the lower end of the cap 31 of the lid 20 goes over an circumferential linear engaging convex 5 provided on the cylindrical opening 2 of the container body 1 and engages with the circumferential linear engaging convex 5. By this engagement, the lid 20 can be rotatably attached and fixed to the cylindrical opening 2.

FIG. 1 illustrates a condition where the over cap 41 is attached to a screwed portion 8 provided at the upper end of the cylindrical skirt 1*a* by screw engagement. It is possible to prevent volatilization of the contents by additionally using a packing 43.

The use of the container in a condition where the above components are attached is now discussed. FIGS. 1 and 3(*a*)

illustrate a condition prior to use, showing the container body 1, the rotor 11 and the lid 20 joined to one another with a packing 42 provided on the upper end surface of the cylindrical opening 2. In this condition, an storage chamber R (hatched region in FIG. 3(*a*) is formed by the peripheral wall 4, the bottom wall 3 and the fixed partitioning plate 7 of the container body 1, the cylindrical shaft piece 12 and the rotatable partitioning plate 13 of the rotor 11, and the bottom plate 22 (packing 42). The contents are stored within the storage chamber R.

In this condition, the blade 15 formed at the edge of the sliding member 14 made of soft material is brought into linearly and tightly sliding contact with the area from the peripheral wall 4 to the bottom wall 3 of the container body 1. The edge of the fixed partitioning plate 7 is brought into sliding contact with the outer circumferential surface of the cylindrical shaft piece 12. Thus, the storage chamber R containing the creamy contents can be substantially closed except the area of the outlet hole 24 utilizing the effect of the packing 42.

As indicated by chain double-dashed lines in FIGS. 3(*a*) and 3(*b*), the outlet hole 24 and the air intake hole 26 are disposed on the peripheral region of the bottom plate 22 of the lid part 21 with the rotatable partitioning plate 13 interposed therebetween. Also, as indicated by a void arrow in FIG. 4, a flow path of the contents extends from the inside of the container 1 through the outlet hole 24 and the flow passage 25 to the discharge opening 33.

When the lid 20 is rotated in the direction of the arrow shown in FIG. 3(*a*) with respect to the container body 1 (obviously, the container body 1 can be rotated while fixing the lid 20 since the container body 1 and the lid 20 are relatively rotatable), the central angle between the partitioning plates 7 and 13 forming the storage chamber R decreases. As a result, the contents are pressed and discharged from the inside of the container body 1 through the outlet hole 24, the flow passage 25 and the discharge opening 33 to the upper surface of the top plate 32*a*. The outside air is introduced through the air intake hole 26 to the area from which the contents are discharged.

In the relative rotation between the partitioning plates 7 and 13, the linear speed of the movement of the partitioning plates is higher at the peripheral position of the container body 1. Thus, the contents can be discharged through the outlet hole 24, flow passage 25 and discharge opening 33 substantially in synchronization with the rotational operation, i.e., without time lag, by providing the outlet hole 24 on the peripheral portion of the bottom plate 22.

Obviously, it is possible to provide the discharge opening 33 on a top wall 32 of the lid 20 which is formed as a one-piece cylindrical component having a top, and to form the outlet hole 24 on the upper region of the cylindrical shaft piece 12 and the downwardly extending shaft 23, such that the pressed contents can be discharged therethrough to the upper surface of the top wall 32. In this structure, however, time lag is caused compared with the structure in this embodiment when the contents have relatively high viscosity or visco-elasticity.

FIG. 3(*b*) illustrates a condition where the rotatable partitioning plate 13 has made almost a round and contacted the fixed partitioning plate 7 after the contents are used up. During the rotation of the rotatable partitioning plate 13, the blade 15 provided at the edge of the sliding member 14 made of soft material is brought into linearly and tightly sliding contact with the area from the peripheral wall 4 to the bottom wall 3 of the container body 1 while being elastically deformed. Accordingly, the rotational operation can be smoothly effected with slight resistance, and thus an appropriate amount of discharge can be easily and securely obtained.

In addition, the contents can be completely scraped from the inner surface of the container body 1 by the blade 15 without leaving the contents inside the container. Thus, the contents can be used up without any loss.

Figure 5:
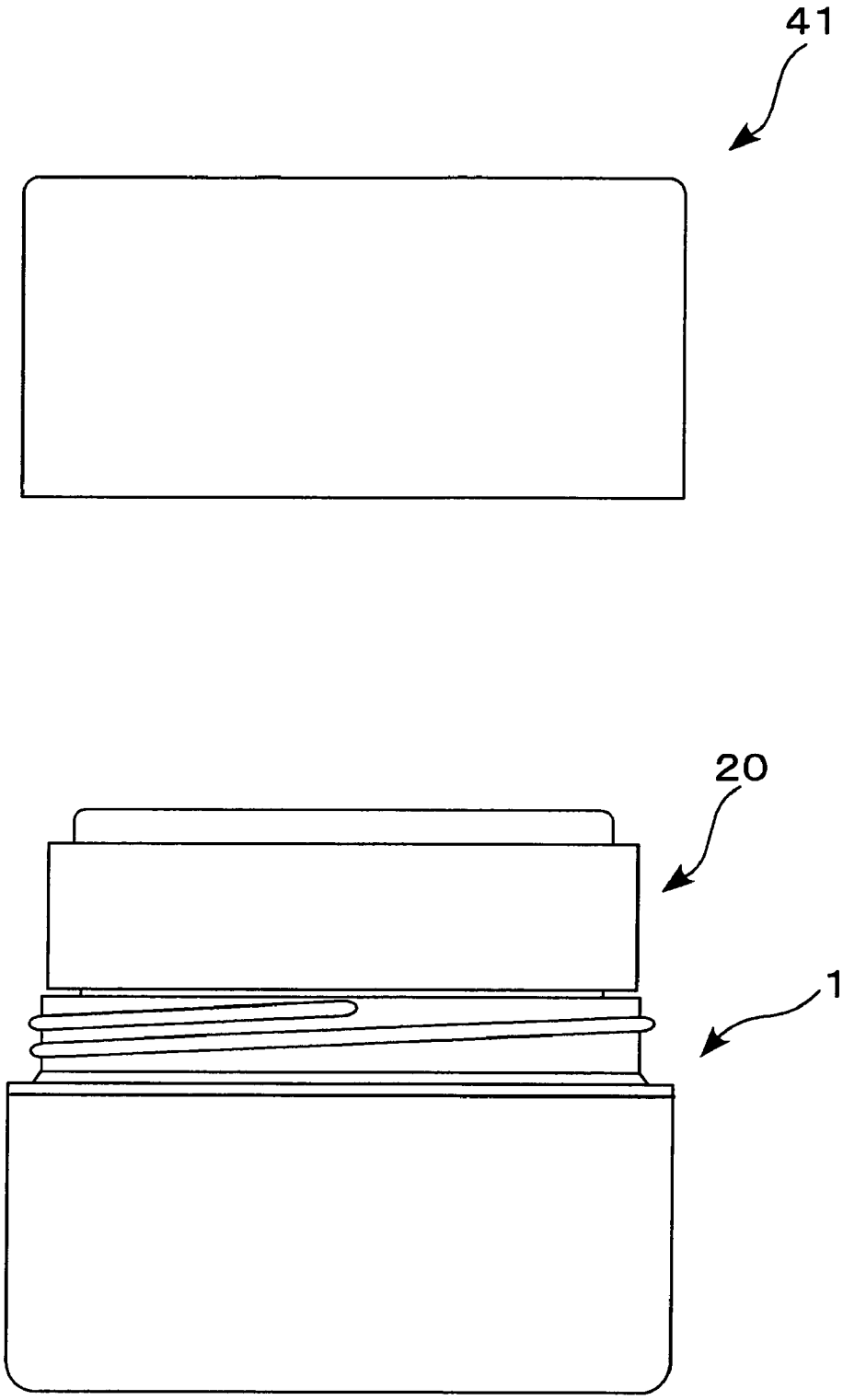
FIG. 5 is a front view illustrating a container main body and an over cap detached therefrom in a second embodiment according to the invention.
Figure 6:
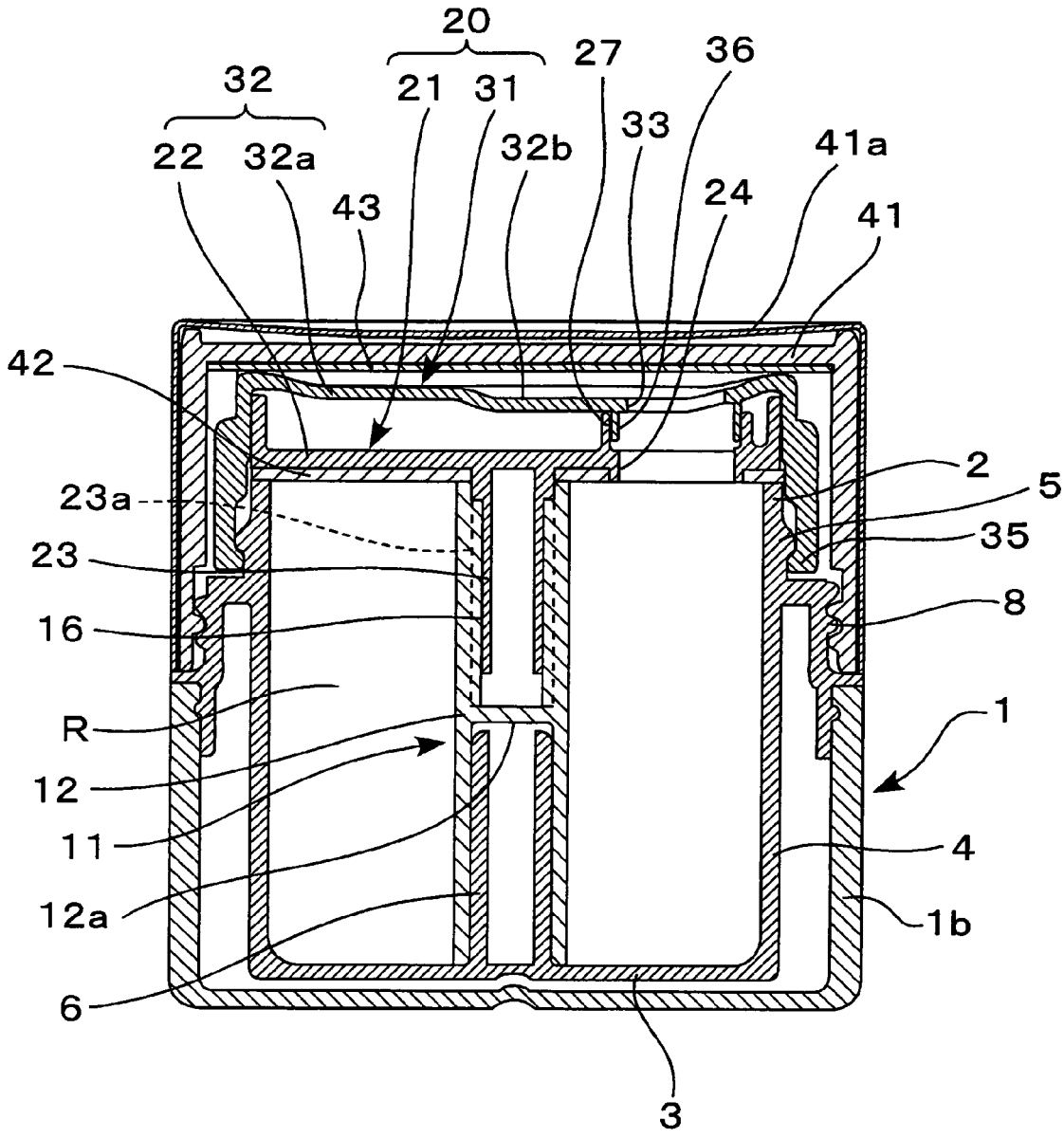
FIG. 6 is a vertical cross-sectional view of the container shown in FIG. 5.
Figure 7:
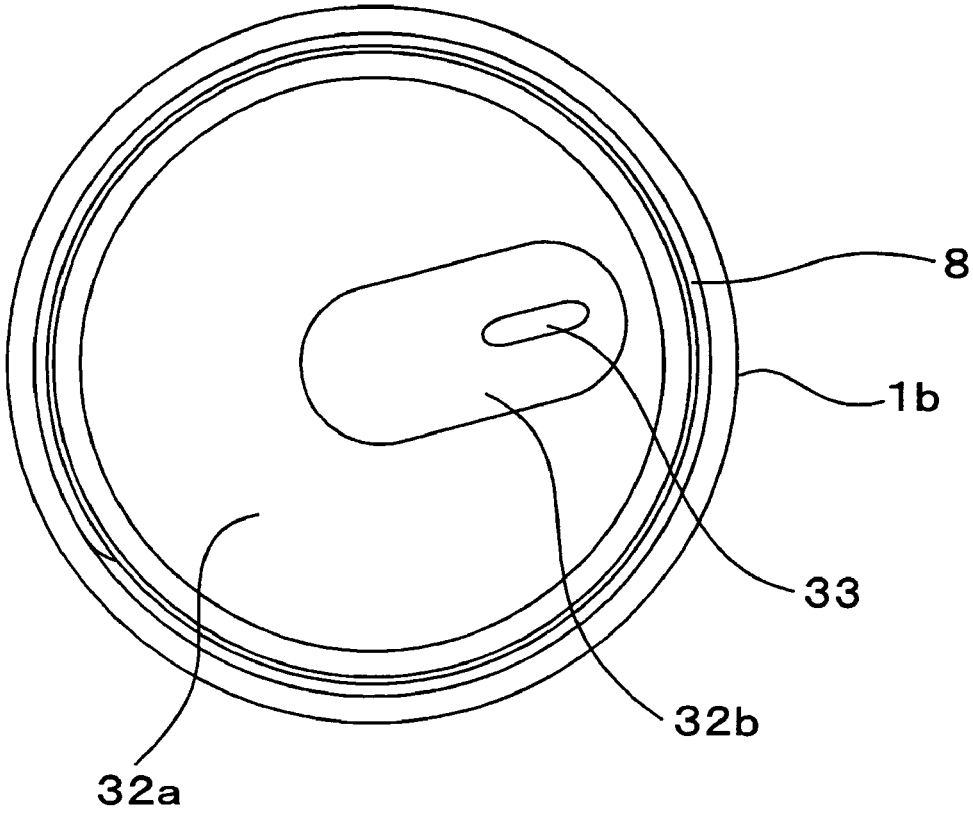
FIG. 7 is a plan view illustrating a condition where the over cap is removed from the container shown in FIG. 5.
Figure 8:
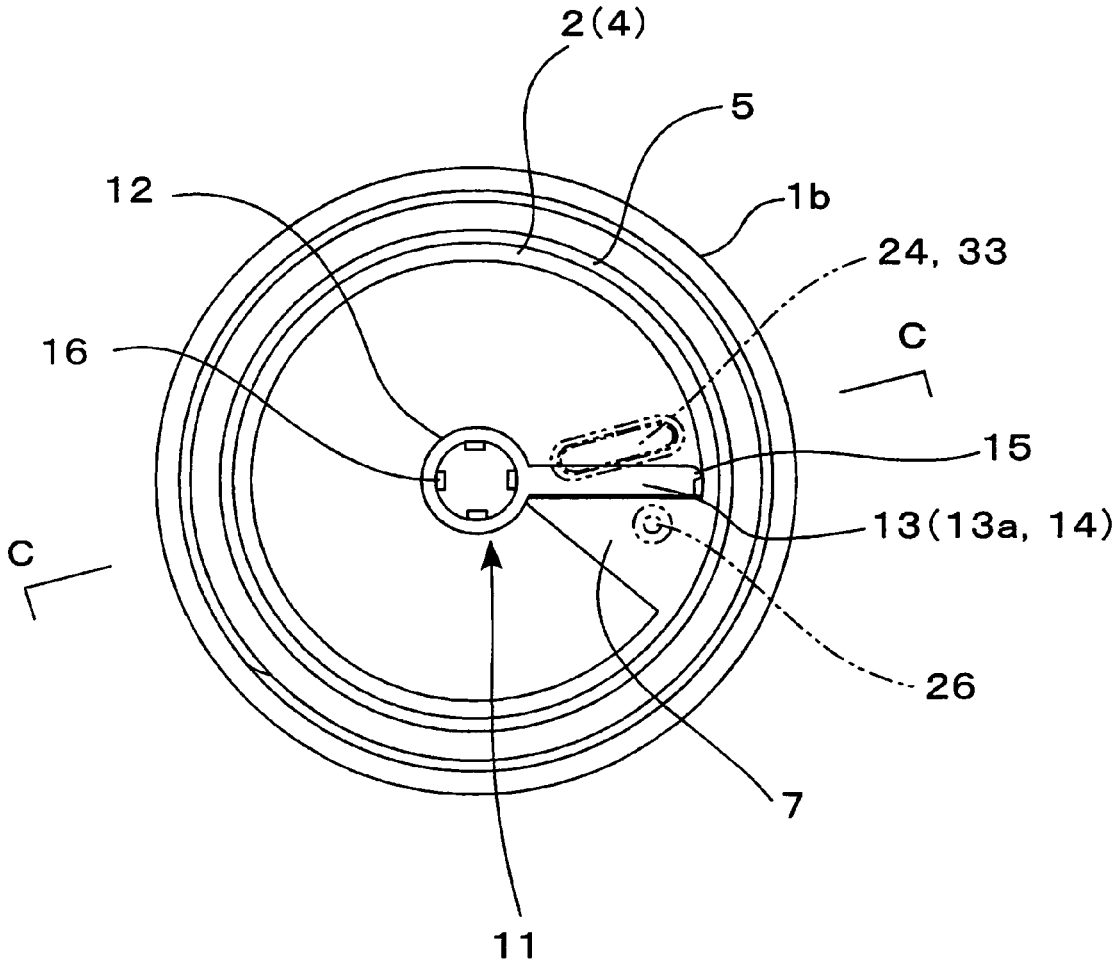
FIG. 8 is a plan view illustrating a condition prior to use where the over cap and a lid are removed from the container shown in FIG. 5.

FIGS. 5 through 8 illustrate a discharge container in a second embodiment according to the invention. FIG. 5 is a front view illustrating the container 1 and the over cap 41 detached therefrom. FIG. 6 is a vertical cross-sectional view of the container taken along a line C-C in FIG. 8. FIG. 7 is a plan view illustrating a condition where the over cap 41 is removed. FIG. 8 is a plan view illustrating a condition prior to use where the lid 20 is further removed.

The main components of the container in this embodiment are the container body 1, the rotor 11 and the lid 20, all made of synthetic resin, and the over cap 41 covers the lid 20 from above, as in the first embodiment. Differences between this embodiment and the first embodiment are mainly discussed herein.

In this embodiment, an outside bottom 1*b* is used in lieu of the cylindrical skirt 1*a* of the container body 1 in the first embodiment, such that the container body 1 including the bottom can be a dual-structured container. The rotor 11 is an integrally molded component having the cylindrical shaft piece 12 and the rotatable partitioning plate 13. For more decorative, the container has an over cap cover 41*a* made of aluminum attached to the outside of the over cap 41, and a cap cover 31*a* also made of aluminum attached to the outside surface of the side wall of the cap 31.

The lid 20 is constituted by the two components of the lid part 21 and the cap 31 as in the first embodiment. The single elliptical outlet hole 24 is provided on the bottom plate 22 of the lid part 21, and a short and cylindrical engaging piece 27 upwardly extends from the periphery of the outlet hole 24. The elliptical discharge opening 33 is provided on the top plate 32 of the cap 31 in a position opposed to the outlet hole 24. A short and cylindrical engaging piece 36 extends downwardly from the periphery of the discharge opening 33 to engage with the short and cylindrical engaging piece 27. A large elliptical concave 32*b* is provided on the upper surface of the top plate 32*a* such that the concave 32*b* surrounds the discharge opening 33.

When the lid 20 is rotated, the contents are discharged through the outlet hole 24 and the discharge opening 33 to the upper surface of the top plate 32*a*. In this structure, the discharged contents can be collected on the concave 32*b*.

The present invention is not limited to the above embodiments. For example, while the area from the barrel to the bottom of the container body is dual-structured in the above embodiments, this area may have an ordinary single structure in accordance with the purpose of use. The positions of the discharge opening and the outlet hole may be determined in accordance with the purpose.

INDUSTRIAL APPLICABILITY

In the discharge container according to the invention described above, the lid can be smoothly rotated and the contents can be taken out without loss. Accordingly, it is expected that the container of the invention can be used in broader fields such as cosmetics and medical supplies.

The invention claimed is:

1. A discharge container, comprising:

a cylindrical container body with a bottom (1) which includes a cylindrical wide opening (2) disposed at the top end of the container body (1), a support (6) extending upward from a bottom wall (3) along a center axis, and a fixed partitioning plate (7) extending from a region from a peripheral wall (4) to a bottom wall (3) as a base end to partition the inside of the container body (1) in a radial direction;

a rotor (11) which includes a cylindrical shaft piece (12) rotatably engaging with the outer surface of the support (6), and a rotatable partitioning plate (13) extending from the cylindrical shaft piece (12) as a base end to be arranged in a radial direction along with the fixed partitioning plate (7); and a cylindrical lid with a top (20) which has a top wall (32) having a saucer-shaped upper surface, and a downwardly extending shaft (23) extending downwardly from the lower surface of the top wall (32) and engaging with the inner surface of the cylindrical shaft piece (12) from above such that the downwardly extending shaft (23) cannot rotate therein, the lid (20) covering the cylindrical opening (2) as a lid and rotatably engaging with the cylindrical opening (2), wherein:

the edge of the fixed partitioning plate (7) is brought into sliding contact with the cylindrical shaft piece (12);

the edge of the rotatable partitioning plate (13) is formed by a spatula-shaped sliding member (14) made of soft material and is brought into sliding and linear contact with an area from the peripheral wall (4) to the bottom wall (3) of the container body (1);

the lower surface of the top wall (32) is brought into sliding contact with the upper end surfaces of the cylindrical opening (2) and the fixed partitioning plate (7) and brought into contact with the upper end surface of the rotatable partitioning plate (13);

an storage chamber (R) is formed by the fixed partitioning plate (7), the rotatable partitioning plate (13), the peripheral wall (4), the bottom wall (3), the cylindrical shaft piece (12), and the top wall (32);

a discharge opening (33) communicating with the storage chamber (R) is provided on the top wall (32); and the capacity of the storage chamber (R) is reduced by decreasing a central angle between the fixed partitioning plate (7) and the rotatable partitioning plate (13) by the relative rotation between the container body (1) and the lid (20), whereby contents within the container are pressed and discharged from the discharge opening (33) to the upper surface of the top wall (32).

2. A discharge container according to claim 1, wherein the lower surface of the top wall (32) is brought into sliding contact with the upper end surfaces of the cylindrical opening (2) and the fixed partitioning plate (7) and brought into contact with the upper end surface of the rotatable partitioning plate (13) via a packing (42).

3. A discharge container according to claim 1, wherein:

the lid (20) includes a short cylindrical lid part with a bottom (21) having a bottom plate (22), and a cylindrical cap with a top (31) which has a saucer-shaped top plate (32*a*) having the discharge opening (33) at its center;

the cap (31) covers the lid part (21) from above as a cover such that the cap (31) tightly engages with the outer surface of the lid part (21) and cannot rotate, and rotatably engages with the upper end of the container body (1);

the top wall (32) has double walls of the bottom plate (22) and the top plate (32*a*);

the downwardly extending shaft (23) extends downwardly from the center of the lower surface of the bottom plate (22);

an outlet hole (24) communicating with the inside of the container body (1) is provided on the peripheral region of the bottom plate (22); and a flow passage (25) extending from the outlet hole (24) to the discharge opening (33) is formed between the bottom plate (22) and the top plate (32*a*).

4. A discharge container according to claim 2, wherein:

the lid (20) includes a short cylindrical lid part with a bottom (21) having a bottom plate (22), and a cylindrical cap with a top (31) which has a saucer-shaped top plate (32*a*) having the discharge opening (33) at its center;

the cap (31) covers the lid part (21) from above as a cover such that the cap (31) tightly engages with the outer surface of the lid part (21) and cannot rotate, and rotatably engages with the upper end of the container body (1);

the top wall (32) has double walls of the bottom plate (22) and the top plate (32*a*);

the downwardly extending shaft (23) extends downwardly from the center of the lower surface of the bottom plate (22);

an outlet hole (24) communicating with the inside of the container body (1) is provided on the peripheral region of the bottom plate (22); and a flow passage (25) extending from the outlet hole (24) to the discharge opening (33) is formed between the bottom plate (22) and the top plate (32*a*).

* * * * *

UNITED STATES PATENT AND TRADEMARK OFFICE

CERTIFICATE OF CORRECTION

PATENT NO. : 7,654,420 B2
APPLICATION NO. : 10/589885
DATED : February 2, 2010
INVENTOR(S) : Honda et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 838 days.

Signed and Sealed this

Twenty-third Day of November, 2010

David J. Kappos

David J. Kappos
*Director of the United States Patent and Trademark Office*